US007225564B1

(12) United States Patent
Gillespie

(10) Patent No.: US 7,225,564 B1
(45) Date of Patent: Jun. 5, 2007

(54) SHOE OUTSOLE

(75) Inventor: Kevin H. Gillespie, Jamaica Plain, MA (US)

(73) Assignee: SRL, Inc., Wilmington, DE (US)

( * ) Notice: Subject to any disclaimer, the term of this patent is extended or adjusted under 35 U.S.C. 154(b) by 575 days.

(21) Appl. No.: 09/458,415

(22) Filed: Dec. 10, 1999

(51) Int. Cl.
*A43B 3/30* (2006.01)
*A43B 13/18* (2006.01)

(52) U.S. Cl. ..... 36/112; 36/28; 36/35 R

(58) Field of Classification Search ..... 36/102, 36/103, 104, 105, 3 B, 25 R, 27, 28, 29, 36/31, 32 R, 36 A, 37, 35 B, 43, 71, 59 C, 36/173, 176, 178, 112, 35 R; D2/900, 902, D2/908, 947, 951, 952, 960, 961
See application file for complete search history.

(56) References Cited

U.S. PATENT DOCUMENTS

| | | | | | |
|---|---|---|---|---|---|
| 2,201,300 | A | | 5/1940 | Prue | |
| 2,814,133 | A | | 11/1957 | Herbst | |
| 2,826,832 | A | | 3/1958 | Rollman et al. | |
| 3,075,305 | A | * | 1/1963 | Shapiro et al. | 36/112 |
| 3,444,632 | A | * | 5/1969 | Hack et al. | 36/59 C |
| 3,500,561 | A | * | 3/1970 | Epstein | 36/92 |
| 3,748,951 | A | * | 7/1973 | Orndorff, Jr. | 36/32 R |
| 3,885,328 | A | * | 5/1975 | Hirasawa | 36/112 |
| 4,667,423 | A | | 5/1987 | Autry et al. | |
| 4,897,936 | A | * | 2/1990 | Fuerst | 36/30 A |
| 5,185,943 | A | | 2/1993 | Tong et al. | |
| 5,440,826 | A | | 8/1995 | Whatley | |
| 5,572,804 | A | | 11/1996 | Skaja et al. | |
| 5,718,064 | A | | 2/1998 | Pyle | |
| 5,725,823 | A | | 3/1998 | Finn et al. | |
| 5,775,005 | A | * | 7/1998 | McMlelland | 36/31 |
| 5,794,359 | A | * | 8/1998 | Jenkins et al. | 36/28 |
| 5,815,949 | A | * | 10/1998 | Sessa | 36/28 |
| D405,247 | S | | 2/1999 | Bouchoms | |
| 5,875,568 | A | * | 3/1999 | Lennihan, Jr. | 36/28 |
| 5,926,974 | A | | 7/1999 | Friton | |
| D417,946 | S | * | 12/1999 | Turner | D2/960 |
| 6,023,859 | A | * | 2/2000 | Burke et al. | 36/28 |
| 6,026,593 | A | * | 2/2000 | Harmon-Weiss et al. | 36/28 |
| 6,092,251 | A | * | 7/2000 | Tomat | 36/30 R |
| 6,176,025 | B1 | * | 1/2001 | Patterson et al. | 36/28 |

* cited by examiner

*Primary Examiner*—Jila M Mohandesi
(74) *Attorney, Agent, or Firm*—Fish & Richardson P.C.

(57) ABSTRACT

A shoe outsole includes an outer member with an inner heel region. An inner member is located in the inner heel region and includes a ground-contacting surface. The inner member has a softer durometer than the outer member. The inner member contains a liquid or gas. The outer member includes a back wall having a rounded contour extending smoothly between a horizontal plane and a vertical plane. A plurality of grooves are defined in a lower forefoot region and an upper forefoot region of the shoe outsole. The lower forefoot region includes a plurality of ridges interdigitated with the grooves. At least one of the grooves extends toward a front edge of the shoe outsole beyond a ground-engaging portion of the lower forefoot region when flatfooted.

37 Claims, 6 Drawing Sheets

SHOE OUTSOLE

BACKGROUND OF THE INVENTION

The invention relates to a shoe outsole, and, in particular, to a shoe outsole for a baby shoe.

Shoe outsoles generally have grooves in their lower surface to provide flexibility. In addition, lugs or inserts may protrude from the lower surface to provide traction.

SUMMARY OF THE INVENTION

According to the invention, a shoe outsole includes an outer member with an inner heel region. An inner member is located in the inner heel region and includes a ground-contacting surface. The inner member has a softer durometer than the outer member.

Embodiments of this aspect of the invention may include one or more of the following features. The inner member contains a liquid or gas. The inner member extends to within about 2 mm of a back edge of the shoe outsole. The outer member includes an intermediate region. An intermediate member is located in the intermediate region and has a softer durometer than the outer member. The intermediate member extends to within about 1.5 mm of a front edge of the shoe outsole and within about 2 mm of a back edge of the shoe outsole. The outer member includes a back wall having a rounded contour extending smoothly between a horizontal plane and a vertical plane.

According to another aspect of the invention, a shoe outsole includes a member having a lower forefoot region and an opposite, upper forefoot region. A plurality of grooves are defined in both the lower forefoot region and the upper forefoot region.

Embodiments of this aspect of the invention may include one or more of the following features. The grooves in the lower forefoot region are substantially parallel, and the grooves in the upper forefoot region are substantially parallel. The grooves in the lower forefoot region have a depth of about 2 mm, and the grooves in the upper forefoot region have a depth of about 1 mm. The grooves in the lower forefoot region and in the upper forefoot region are generally transverse, e.g., substantially perpendicular, to a longitudinal axis of the shoe outsole. At least some of the grooves in the lower forefoot region extend to both side edges of the shoe outsole. The grooves in the lower forefoot region extend to within about 1.5 mm of a front edge of the shoe outsole, beyond a ground-engaging portion of the lower forefoot region when flatfooted. The lower forefoot region includes a plurality of ridges. At least some of the ridges are interdigitated with the grooves in the lower forefoot region. The member includes a back wall having a rounded contour extending smoothly between a horizontal plane and a vertical plane. The member includes an inner heel region. An inner member is located in the inner heel region and has a softer durometer than the member.

According to another aspect of the invention, a shoe outsole includes a member having a ground-contacting surface including a toe region. A plurality of grooves are defined in the toe region. At least one of the grooves extends toward a front edge of the shoe outsole beyond a ground-engaging portion of the toe region when flatfooted.

Embodiments of this aspect of the invention may include one or more of the following features. The grooves have a depth of about 2 mm, extend to within about 3 mm of the front edge of the shoe outsole, and extend toward side edges of the shoe outsole. The grooves are substantially parallel to each other and are generally transverse, e.g., substantially perpendicular, to a longitudinal axis of the shoe outsole. The member includes a back wall having a rounded contour extending smoothly between a horizontal plane and a vertical plane. The member includes an inner heel region. An inner member is located in the inner heel region and has a softer durometer than the member.

According to another aspect of the invention, a shoe outsole includes a member including a forefoot region. A plurality of substantially parallel grooves and a plurality of substantially parallel ridges are located in the forefoot region. At least some of the ridges are interdigitated with the grooves.

Embodiments of this aspect of the invention may include one or more of the following features. The ridges are located at ground contacting regions of the forefoot region. The grooves and the ridges are substantially parallel to each other. The grooves have a depth of about 2 mm and are generally transverse, e.g., substantially perpendicular, to the longitudinal axis of the shoe outsole. The ridges have a depth of about 1 mm and are generally transverse, e.g., substantially perpendicular, to the longitudinal axis of the shoe outsole. The member includes an inner heel region. An inner member is located in the inner heel region and has a softer durometer than the member. The member includes a back wall having a rounded contour extending smoothly between a horizontal plane and a vertical plane.

According to another aspect of the invention, a shoe outsole includes a member having a ground contacting surface, an upper surface, and a sidewall joining the ground contacting surface and the upper surface. The sidewall includes a back wall having a rounded contour extending smoothly between a horizontal plane and a vertical plane.

The ridges and grooves in the upper and lower surfaces of the outsole as well as the rounded back wall in the heel region mimic a baby's natural walking motion during the months of the baby's first steps.

Other features and advantages will be apparent from the following description and from the claims.

DESCRIPTION OF THE PREFERRED EMBODIMENTS

Figure 1:
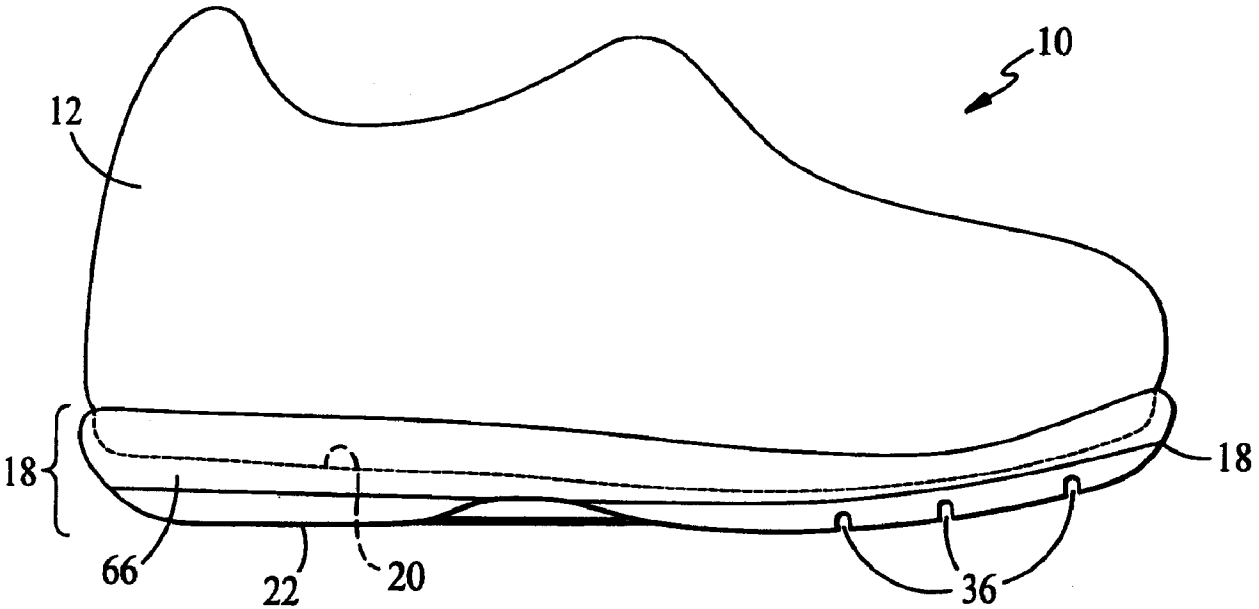
FIG. 1 is a side view of a left shoe with an outsole according to the invention.

Referring to FIG. 1, a shoe 10 includes an upper 12 and an outsole 18. Upper 12 is made from, e.g., leather, canvas, or other suitable material; outsole 18 is made from, e.g., a rubber such as a thermoplastic resin. Outsole 18 has an upper surface 20, a lower surface 22, and a sidewall 66. The outsole 18 dimensions given below are for a typical child's shoe (US size 5) having an overall length of about 146 mm and an overall width of about 68 mm.

Figure 2:
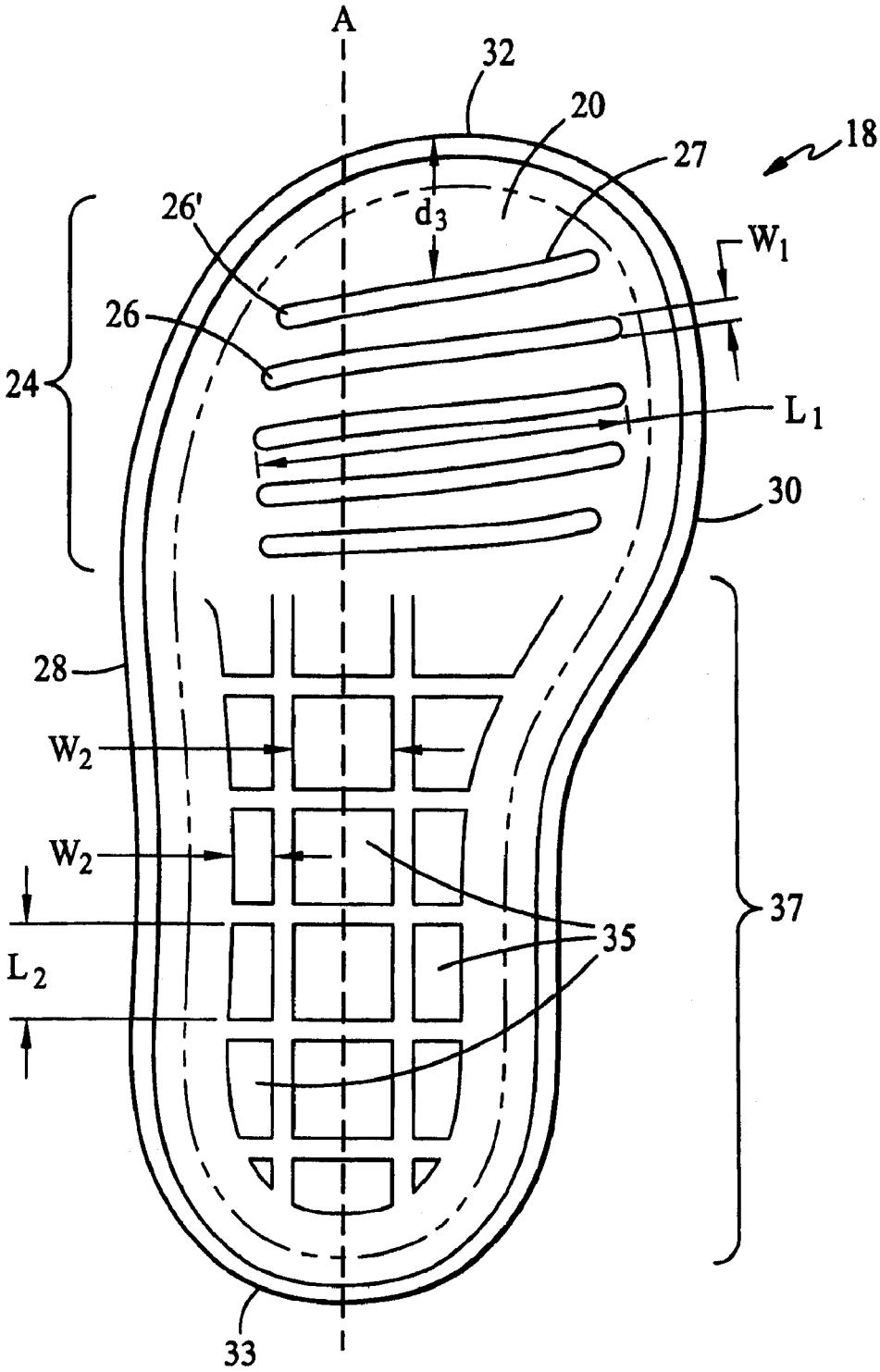
FIG. 2 shows an upper surface of the outsole of FIG. 1.
Figure 4:
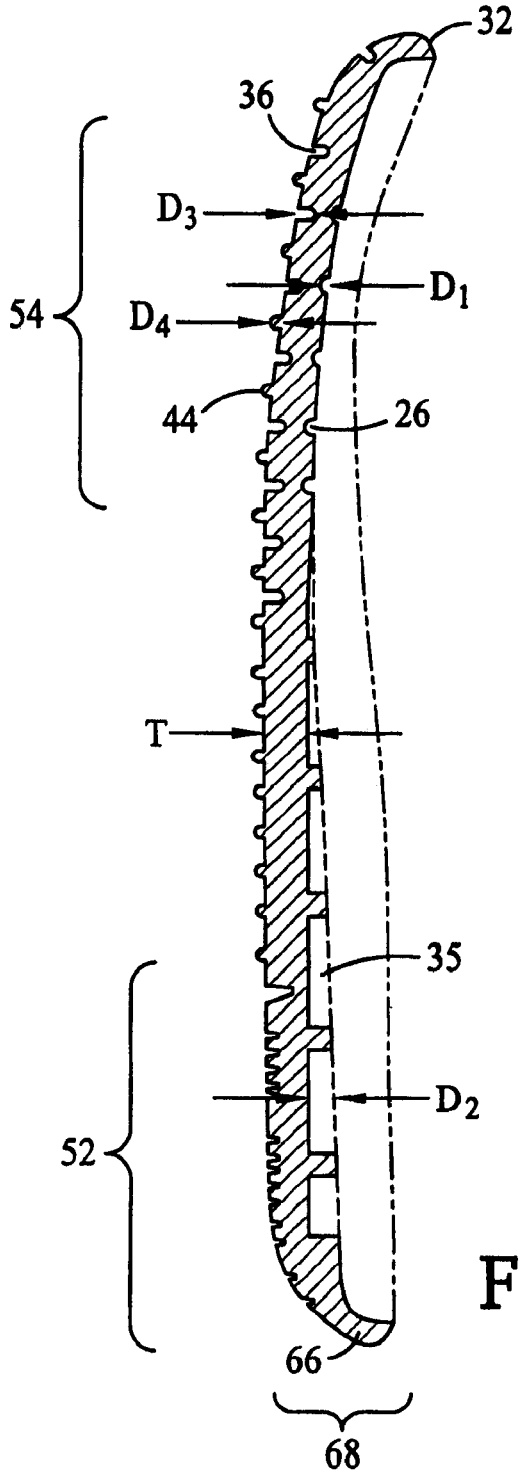
FIG. 4 is a cross-sectional side view of the outsole of FIG. 1.

Referring to FIGS. 2 and 4, outsole 18 has a thickness, T, of about 4.5 mm. Upper surface 20 of outsole 18 includes an upper forefoot region 24, generally corresponding to the area of the wearer's foot from the ball of the foot to the ends of the toes. Upper surface 20 defines a plurality of grooves 26 in upper forefoot region 24 to provide flexibility. Each groove 26 has a width, $W_1$, of about 2.5 mm, and a depth, $D_1$, (see FIG. 4) of about 1 mm. Grooves 26 are substantially parallel to each other and generally perpendicular to a longitudinal axis, A, of outsole 18. Grooves 26 are spaced about 5 mm from each other. Outsole 18 has front and back edges 32, 33, respectively, and left and right side edges 28, 30, respectively. Each groove 26 has a length, $L_1$, of about 44 mm and extends between side edges 28, 30, e.g., within about 3 mm of side edges 28, 30. The forward edge 27 of the most forward groove 26' is within a distance, d3, of about 10 mm from front edge 32. Although five grooves 26 are shown, there may be more or less grooves 26 depending on the size of the shoe.

Upper surface 20 also includes an upper backfoot region 37, generally corresponding to the areas of the arch and heel of a foot. Upper backfoot region 37 defines a plurality of depressions 35 to decrease the weight of the outsole 18. Each depression 35 has a length, $L_2$, of about 12 mm, a width, $W_2$, in the range of about 5 mm to 12 mm, and a depth, $D_2$, (see FIG. 4) of about 1 mm to 4 mm.

Figure 3:
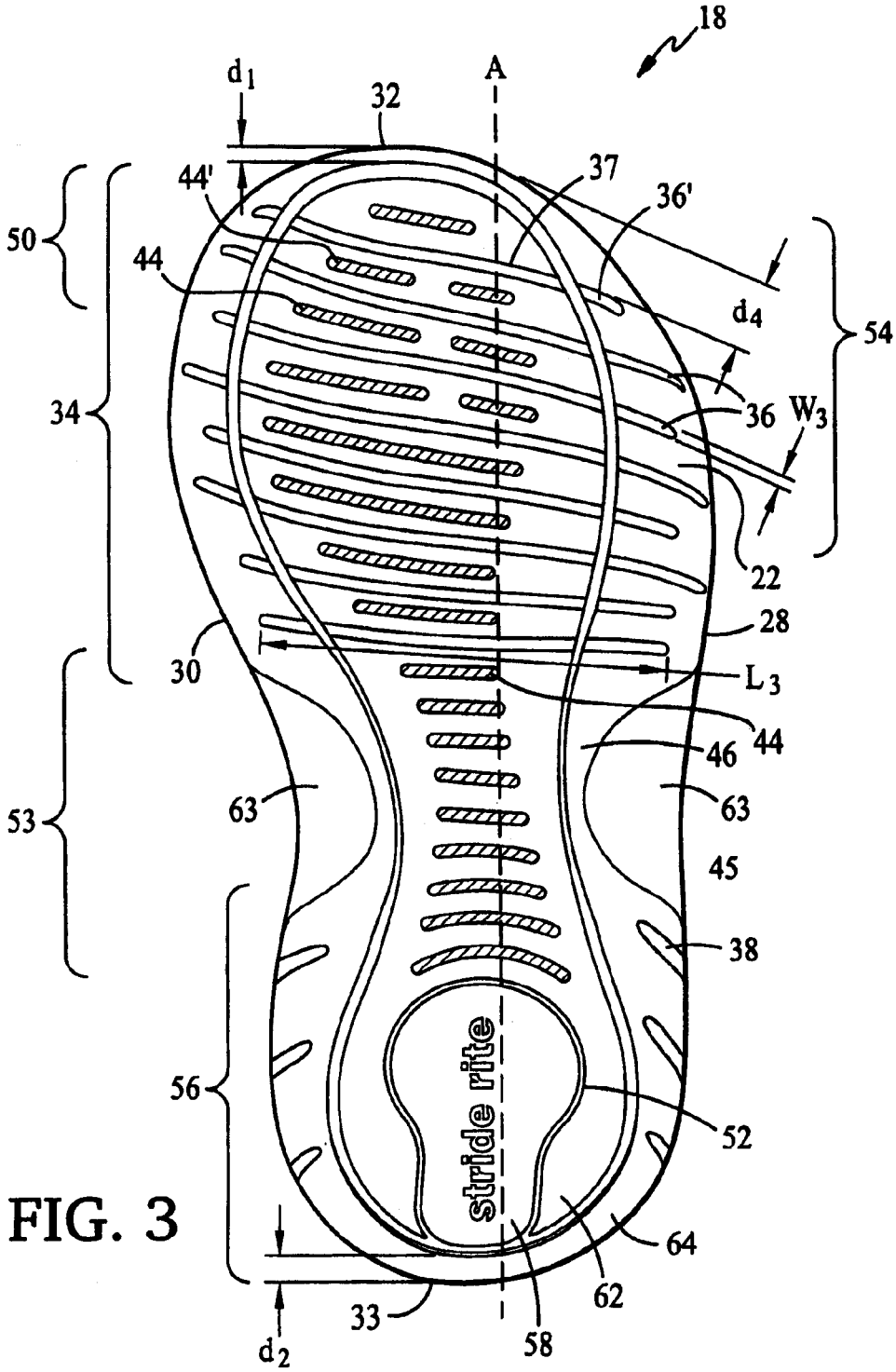
FIG. 3 shows a lower surface of the outsole of FIG. 1.

Referring to FIG. 3, lower surface 22 of outsole 18 has a ground contacting surface 46, and contoured arch regions 63 which are spaced from the ground when walking. Ground contacting surface 46 of lower surface 22 includes an intermediate member 62 and an outer member 64. Outer member 64 extends to front edge 32, back edge 33, and side edges 28, 30. Intermediate member 62 extends to within a distance, $d_1$, of front edge 32 of about 1.5 mm, within a distance, $d_2$, of back edge 33 of about 2 mm, and generally follows the contour of lower surface 22. Intermediate member 62 preferably has a lower (softer) durometer than outer member 64.

Lower surface 22 of outsole 18 includes a lower forefoot region 34, generally corresponding to the area of the foot from the ball of the foot to the ends of the toes. Lower surface 22 defines a plurality of grooves 36 located in lower forefoot region 34 to provide flexibility. Each groove 36 has a width, $W_3$, of about 2.5 mm and a depth, $D_3$, (see FIG. 4) of about 2 mm. Grooves 36 are substantially parallel to each other and perpendicular to longitudinal axis A of outsole 18. Grooves 36 are spaced, e.g., about 6 mm from each other. The length, $L_3$, of each groove 36 is in the range of about 50 mm to 67 mm. Each groove 36 extends towards side edges 28, 30, e.g., within about 10 mm of side edges 28, 30. At least one of grooves 36 extends completely to side edges 28, 30 (see FIG. 1, where three grooves 36 are shown extending completely to the side edges for increased flexibility). The forward edge 39 of the most forward groove 36' is within a distance, $d_4$, of about 5 mm from front edge 32. Although eight grooves 36 are shown in lower forefoot region 34, there may be more or less grooves 36 depending on the size of the shoe.

Lower forefoot region 34 includes a toe region 50. At least some of the grooves 36 extend into toe region 50. Toe region 50 extends to front edge 32 of lower surface 22 beyond a ground-engaging portion 54 (see FIG. 4) of lower forefoot region 34 when flatfooted. Grooves 36 in toe region 50 facilitate flexibility.

Lower surface 22 includes a heel region 56 that defines additional grooves 38. Grooves 38 in heel region 56 extend completely to side edges 28, 30. Although six grooves 38 are shown in heel region 56, there may be more or less grooves 38, or no grooves 38.

Interdigitated with grooves 36 in lower forefoot region 34 are ridges 44 which facilitate propulsion during walking. Each ridge 44 protrudes a distance, $D_4$, (see FIG. 4) of about 2 mm from surface 22. Ridges 44 are substantially parallel to each other and to grooves 36. Each ridge 44 extends towards side edges 28, 30, e.g., within about 10 mm of side edges 28, 30. The most forward ridge 44 is within about 8 mm of front edge 32. Lower surface 22 also defines a midfoot region 53 including ridges 45 for gripping the ground. Although twenty ridges 44 and 45 are shown, there may be more or less ridges 44 or 45 depending on the size of the shoe. Ridges 44 and 45 are located on outsole 18 in areas generally corresponding to regions of the child's foot most in contact with the ground during walking.

Heel region 56 defines a pocket 52 containing an inner heel member 58. Inner heel member 58 is formed from, e.g., a rubber having a lower (softer) durometer than the remainder of heel region 56, and preferably lower than the remainder of outsole 18. Alternatively, inner heel member 58 can be a bladder filled with a liquid or gas. Inner heel member 58 provides a cushion for the heel of the foot while walking.

Referring to FIG. 4, sidewall 66 of outsole 18 includes a back wall 68 that extends smoothly between a horizontal plane and a vertical plane. Having back wall 68 curved in the horizontal and vertical planes facilitates balance while walking during heel strike.

Figure 5:
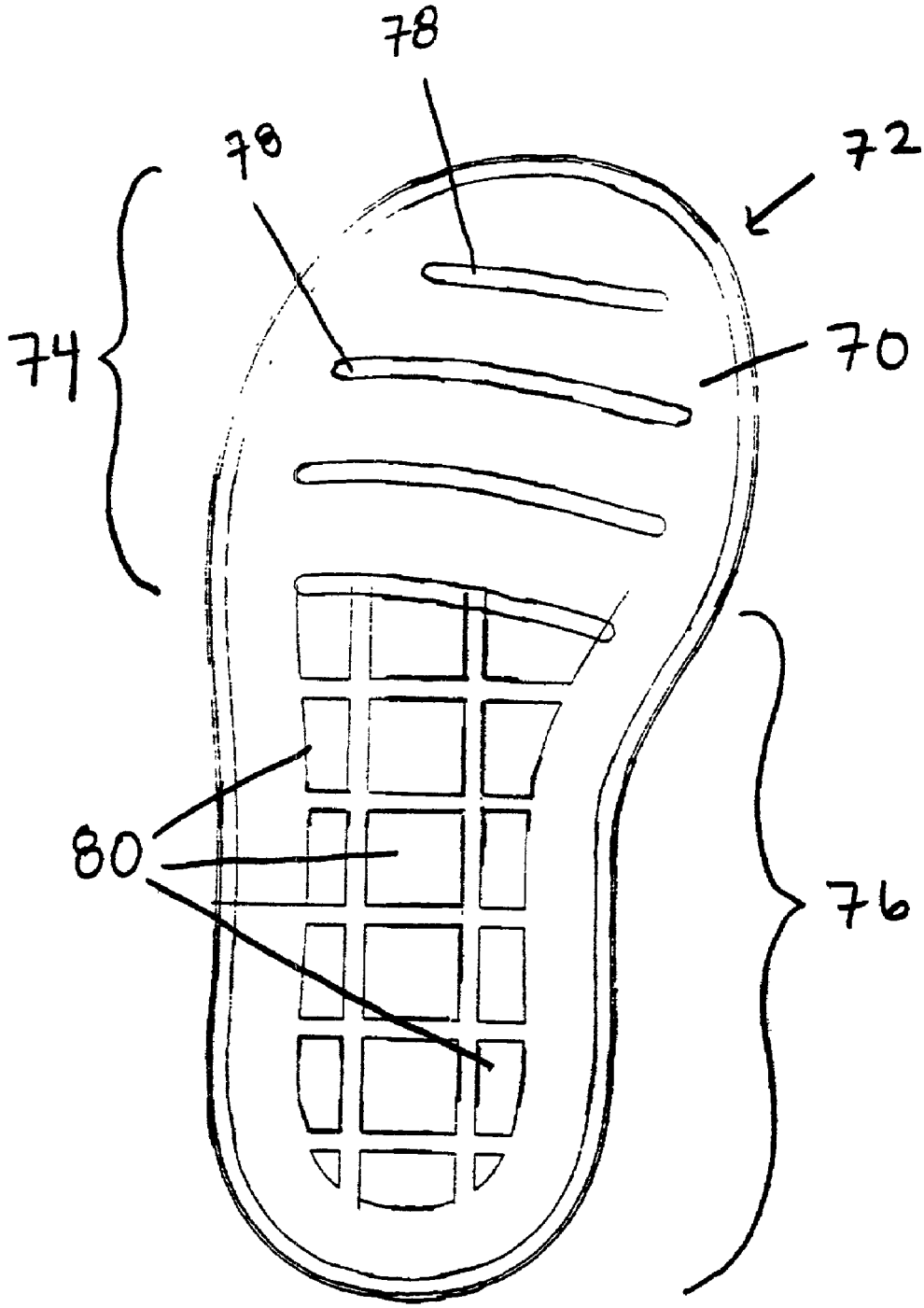
FIG. 5 shows an upper surface of an outsole according to another embodiment of the invention.
Figure 6:
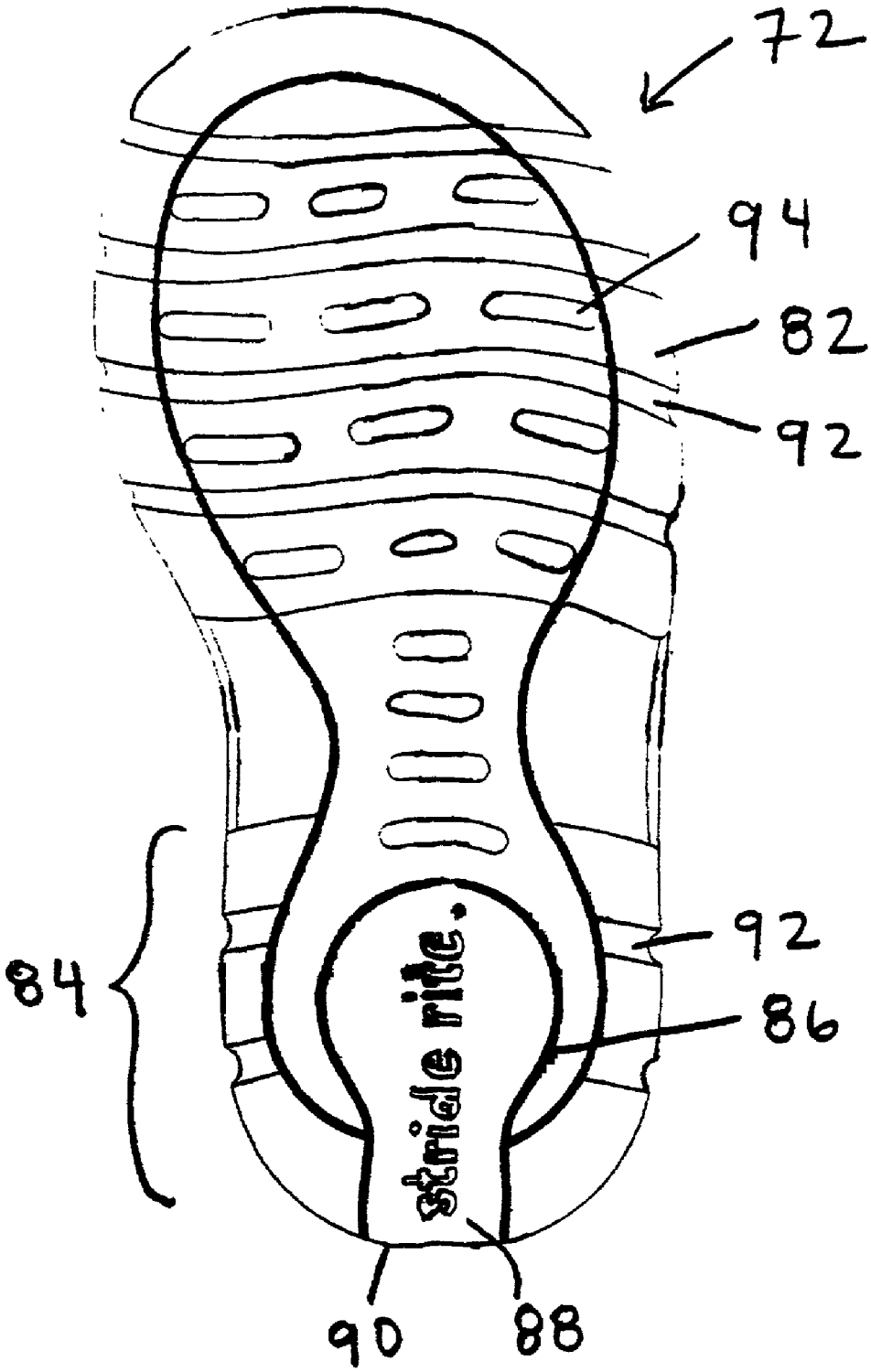
FIG. 6 shows a lower surface of the outsole of FIG. 5.

In another embodiment of the invention, shown in FIGS. 5 and 6, an outsole 72 is configured particularly for outdoor use in inclement weather. Outsole 72 has an upper surface 70 with an upper forefoot region 74 and an upper backfoot region 76. Upper surface 70 defines a plurality of grooves 78, here four grooves being shown, in upper forefoot region 74, and a plurality of depressions 80 in upper backfoot region 76. Grooves 78 have a depth, e.g., of about 1.5 mm. As shown in FIG. 6, outsole 72 has a lower surface 82 with a heel region 84 defining a pocket 86 containing an inner heel member 88. Inner heel member 88 corresponds substantially to inner heel member 58 described above, though in this embodiment inner heel member 88 extends to a back edge 90 of outsole 72. Lower surface 82 defines a plurality of grooves 92 in the toe and heel regions of the outsole extending to the edges of the outsole, and a plurality of discrete ridges 94 in the toe and arch regions of the outsole.

Other embodiments are within the scope of the following claims.

What is claimed is:

1. A shoe outsole for a baby shoe, comprising:

an outer member including an inner heel region;

an inner member located in the inner heel region and including a ground contacting surface, the inner member having a softer durometer than the outer member;

and wherein the outer member includes an intermediate region, an intermediate member being located in the intermediate region of the outer member, between the outer member and the inner member, wherein the intermediate member spans substantially the length of the outer member and has a softer durometer than the outer member;

the shoe outsole being dimensioned for use in a baby shoe, and the inner member being positioned and dimensioned to fit under a baby's heel during use of the baby shoe.

2. The shoe outsole of claim 1 wherein the inner member contains a liquid.

3. The shoe outsole of claim 1 wherein the inner member contains a gas.

4. The shoe outsole of claim 1 wherein the inner member extends to within about 2 mm of a back edge of the outer member.

5. The shoe outsole of claim 1 wherein the intermediate member extends to within about 1.5 mm of a front edge of the outer member.

6. The shoe outsole of claim 1 wherein the intermediate member extends to within about 2 mm of a back edge of the outer member.

7. The shoe outsole of claim 1 wherein the outer member includes a back wall having a rounded contour extending smoothly between a horizontal plane and a vertical plane.

8. The shoe outsole of claim 1 wherein the outer member includes a lower forefoot region, and an upper surface including an opposite, upper forefoot region, there being a plurality of grooves defined in the lower forefoot region and a plurality of grooves defined in the upper forefoot region.

9. The shoe outsole of claim 8 wherein the grooves in the lower forefoot region are substantially parallel.

10. The shoe outsole of claim 8 wherein the grooves in the upper forefoot region are substantially parallel.

11. The shoe outsole of claim 8 wherein the grooves in the lower forefoot region are generally transverse to a longitudinal axis of the shoe outsole.

12. The shoe outsole of claim 11 wherein the grooves in the lower forefoot region are substantially perpendicular to the longitudinal axis of the shoe outsole.

13. The shoe outsole of claim 8 wherein the grooves in the upper forefoot region are generally transverse to a longitudinal axis of the shoe outsole.

14. The shoe outsole of claim 13 wherein the grooves in the upper forefoot region are substantially perpendicular to the longitudinal axis of the shoe outsole.

15. The shoe outsole of claim 8 wherein at least some of the grooves in the lower forefoot region extend to both side edges of the shoe outsole.

16. The shoe outsole of claim 8 wherein the grooves in the lower forefoot region extend toward a front edge of the shoe outsole beyond a ground engaging portion of the lower forefoot region when flat footed.

17. The shoe outsole of claim 8 wherein the lower forefoot region includes a plurality of ridges.

18. The shoe outsole of claim 17 wherein at least some of the ridges are interdigitated with the grooves in the lower forefoot region.

19. The shoe outsole of claim 8 wherein the outer member includes a back wall having a rounded contour extending smoothly between a horizontal plane and a vertical plane.

20. The shoe outsole of claim 1 wherein the outer member has a ground contacting surface including a toe region, there being a plurality of grooves defined in the toe region, at least one of the grooves extending toward a front edge of the shoe outsole beyond a ground engaging portion of the toe region when flat footed.

21. The shoe outsole of claim 20 wherein the grooves are substantially parallel.

22. The shoe outsole of claim 20 wherein the grooves extend toward side edges of the shoe outsole.

23. The shoe outsole of claim 20 wherein the grooves are generally transverse to a longitudinal axis of the shoe outsole.

24. The shoe outsole of claim 23 wherein the grooves are substantially perpendicular to the longitudinal axis of the shoe outsole.

25. The shoe outsole of claim 20 wherein the outer member includes a back wall having a rounded contour extending smoothly between a horizontal plane and a vertical plane.

26. The shoe outsole of claim 1 wherein the outer member includes a forefoot region, there being a plurality of substantially parallel grooves located in the forefoot region, and a plurality of substantially parallel ridges, at least some of the ridges being interdigitated with the grooves.

27. The shoe outsole of claim 26 wherein the ridges are located at ground contacting regions of the forefoot region.

28. The shoe outsole of claim 26 wherein the grooves and the ridges are substantially parallel to each other.

29. The shoe outsole of claim 26 wherein the grooves are generally transverse to a longitudinal axis of the shoe outsole.

30. The shoe outsole of claim 29 wherein the grooves are substantially perpendicular to the longitudinal axis of the shoe outsole.

31. The shoe outsole of claim 26 wherein the ridges are generally transverse to a longitudinal axis of the shoe outsole.

32. The shoe outsole of claim 31 wherein the ridges are substantially perpendicular to the longitudinal axis of the shoe outsole.

33. The shoe outsole of claim 26 wherein the outer member includes a back wall having a rounded contour extending smoothly between a horizontal plane and a vertical plane.

34. The shoe outsole of claim 1 wherein the outer member has a ground contacting surface, an upper surface, and a side wall joining the ground contacting surface and the upper surface, the side wall including a back wall having a rounded contour extending smoothly between a horizontal plane and a vertical plane.

35. The shoe outsole of claim 1 wherein the ground contacting surface further includes an intermediate member, between the inner member and the outer member, having a softer durometer than the outer member, the durometer of the inner member being softer than the durometer of the intermediate member.

36. A shoe outsole for a baby shoe, comprising:

an outer member;

an inner member, located in an inner heel region of the shoe outsole; and an intermediate member located in an intermediate region of the shoe outsole, between the outer member and the inner member, the intermediate member having a softer durometer than the outer member, and including a plurality of ridges, and the inner member including a ground contacting surface, and having a softer durometer than the outer member;

the shoe outsole being dimensioned for use in a baby shoe, and the inner member being positioned and dimensioned to fit under a baby's heel during use of the baby shoe.

37. A shoe outsole for a baby shoe, comprising:

an outer member including, a lower forefoot region, an opposite upper forefoot region, and a back wall, the back wall having a rounded contour extending smoothly between a horizontal plane and a vertical plane;

wherein the outer member includes an intermediate region, an intermediate member being located in the intermediate region and wherein the intermediate member spans substantially the length of the outer member and has a softer durometer than the outer member;

an inner member located in an inner heel region of the shoe outsole, and including a ground contacting surface, the inner member having a softer durometer than the outer member;

a plurality of substantially parallel grooves defined in the lower forefoot region, at least one of the plurality of grooves extending toward a front edge of the shoe outsole beyond a ground engaging portion of the lower forefoot region when flat footed;

a plurality of substantially parallel ridges included in the lower forefoot region, at least some of the ridges being interdigitated with the grooves in the lower forefoot region; and a plurality of substantially parallel grooves defined in the upper forefoot region;

the shoe outsole being dimensioned for use in a baby shoe, and the inner member being positioned and dimensioned to fit under a baby's heel during use of the baby shoe.

* * * * *